United States Patent [19]

Vona, Jr.

[11] 4,160,367

[45] Jul. 10, 1979

[54] DUAL CONTAINER ADDITIVE DISPENSER FOR APPLIANCE

[75] Inventor: Nick Vona, Jr., Springboro, Ohio

[73] Assignee: General Motors Corporation, Detroit, Mich.

[21] Appl. No.: 941,274

[22] Filed: Sep. 11, 1978

[51] Int. Cl.[2] ..... D06F 39/02

[52] U.S. Cl. ..... 68/17 R; 68/207

[58] Field of Search ..... 68/17 R, 207; 134/100; 222/40, 157, 158

[56] References Cited

U.S. PATENT DOCUMENTS

| | | | |
|---|---|---|---|
| 3,019,629 | 2/1962 | Ross | 68/17 R |
| 3,086,379 | 4/1963 | Plante | 68/17 R X |
| 3,696,970 | 10/1972 | Bunnell et al. | 68/17 R X |

*Primary Examiner*—Philip R. Coe

*Attorney, Agent, or Firm*—Edward P. Barthel

[57] ABSTRACT

A liquid additive dispensing device, including interconnected receiving and storage containers, adapted for use with an appliance such as a washing machine with the additive storage container located remotely in the washer cabinet from the additive pour-in or receiving container readily accessible to the operator. The receiving container has a generally funnel-like configuration operative, upon additive being poured into its top inlet, to cause the additive to gravity flow by means of a connecting tube into the first of a series of reservoir portions of the storage container. The storage container is separated into upper and lower chambers with the lower having an outlet discharging gravitationally into conduit means in communication with the treating zone of the appliance. The receiving container has additive level indicating means in the form of stepped surfaces disposed at predetermined descending additive storage levels corresponding to their associated storage container reservoirs. Pressure-responsive valves cooperate with selected reservoir portions such that upon the opening of a dispensing valve the total premeasured quantity of additive stored in the dispensing device is automatically discharged into the treatment zone of the appliance.

1 Claim, 4 Drawing Figures

DUAL CONTAINER ADDITIVE DISPENSER FOR APPLIANCE

This invention relates to an appliance and more particularly to an improved liquid additive measuring and dispensing device for a washing machine.

In the application of various dispensing devices in appliances such as an automatic washing machine, it is desirable to provide for adding liquid washing agents, such as bleach, to the treatment zone at a predetermined time in the cycle of operation. One such automatic dispensing device is shown in U.S. Pat. No. 3,019,629, issued Feb. 6, 1962, assigned to the same assignee as the present invention, wherein the washing agent dispenser fill opening is placed in the viewable space between a vertical tub and the top of the washer cabinet. It has been found, however, that while such a location provides a dispenser fill opening in an otherwise unusable area within the cabinet, space at this location is not available for a holding container of the required capacity.

Accordingly, it is an object of the present invention to provide an improved liquid additive dispenser means having a pour-in container in a readily accessible and viewable location interconnected with a remotely positioned holding container wherein pour-in container means may be utilized to indicate the volume of stored liquid additive in the dispenser means.

It is another object of the present invention to provide an improved liquid additive dispenser means for a laundry machine including a funnel-like pour-in container adapted to be located in a viewable manner adjacent the access opening of the treatment zone of the appliance together with a storage container adapted to be supported in a remote portion of the machine out of sight of the operator. The remote storage container is separated into an upper chamber and a lower chamber with the lower chamber having an outlet formed therein discharging into conduit means in communication with the treatment zone. The upper chamber has a plurality of separate reservoirs disposed one adjacent the other. Valve means are provided for each of the reservoirs wherein upon the first reservoir and the lower chamber having discharged their additive contents into the treatment zones individual valve means for the remaining filled reservoirs automatically open whereby the liquid additive stored therein is also discharged into the treatment zone via the lower chamber whereby a plurality of increased quantities of liquid additive may be dispensed during the laundry machine washing cycle.

Further objects and advantages of the present invention will be apparent from the following description, reference being had to the accompanying drawings wherein a preferred embodiment of the present invention is clearly shown.

Figure 1:
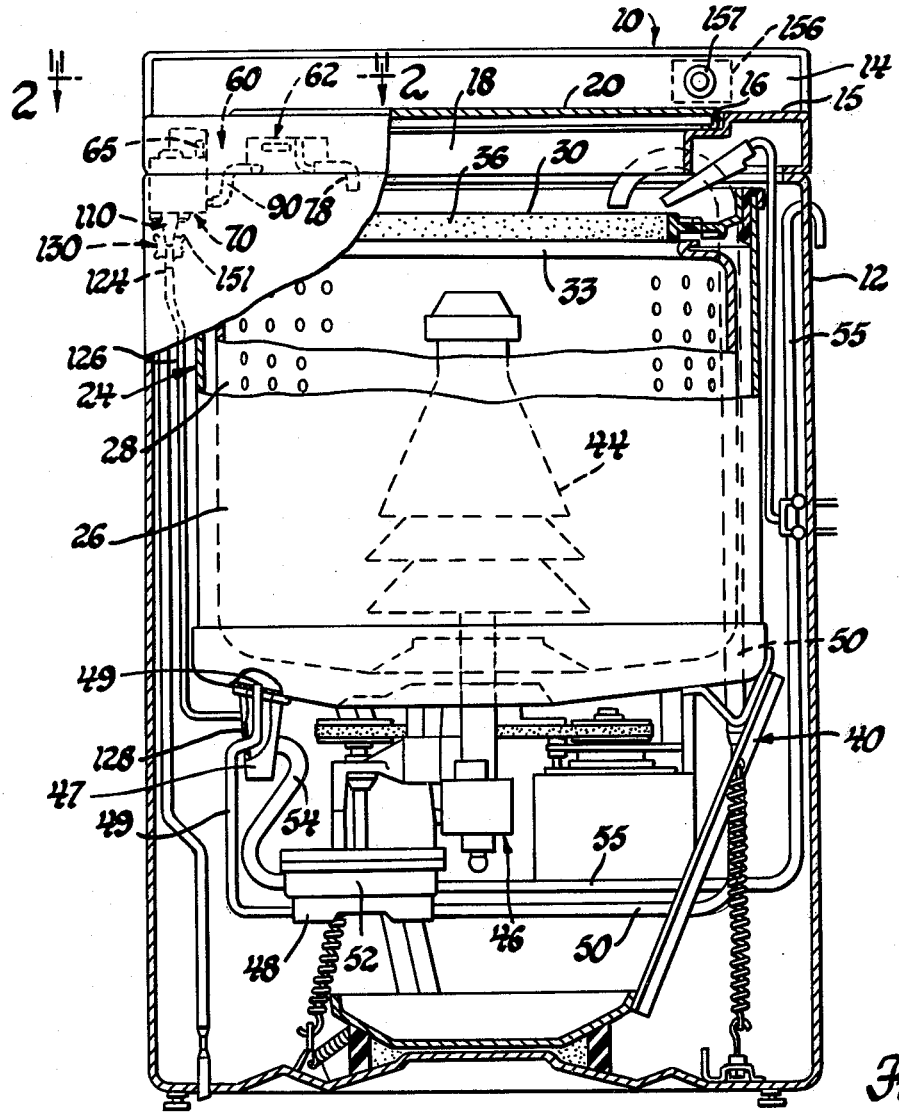
FIG. 1 is a sectional view of a domestic clothes washer provided with the liquid additive dispenser means of the present invention.

In accordance with this invention and with reference to FIG. 1, the washing machine 10 is provided with an outer box-like sheet metal cabinet or casing 12 having an upstanding control housing or console 14. The casing has a top panel 15 provided with recessed portion 16 including an access opening 18 in the top panel of the cabinet 12 which is exposed when the access door or lid 20 is open. The cabinet 12 is shown to enclose a nested tub assembly 24. The assembly includes an open top, imperforate wall container 26 and a perforate wall spin basket 28. Perforations are coextensive with the cylindrical side wall of the spin basket. An annular plastic subtop 30 is sealingly clamped to the open top of the water container 26. The subtop circumscribes the open top of the water container and extends over a rim 33 forming the top opening of the spin basket 28 to define an access collar 36 between the access opening 18 of the cabinet and the top opening of the spin basket.

The tub assembly 24 is mounted on a suspension system shown generally at 40 and more fully taught in the U.S. Pat. No. 3,493,118, granted Feb. 3, 1970. The top assembly includes an agitator 44 which with the spin basket 28 is connected to a drive mechanism shown generally at 46. The drive mechanism may be of a roller drive type taught more fully in U.S. Pat. No. 3,087,321, granted Apr. 30, 1963. In general, mechanism 46 may be operated in one manner to vertically reciprocate or oscillate the agitator 44 for washing clothes in the tub assembly. When the mechanism is operated in another manner, the spin basket 28 is rotated with respect to the water container for centrifuging washing fluid from the clothes in the spin basket.

The conventional water recirculation system for the water container 26 includes a bottom drain sump 47 in addition to the open top access opening 36. A recirculating pump 48 withdraws washing water or liquid from the water container 26 through the inlet 49 to hose 49' and by means of recirculating hose 50 returns the washing liquid to the water container. The purpose of recirculation is to remove lint and other sediment or particulate matter from the recirculating washing liquid.

A conventional drain system for the clothes washer includes a drain pump 52 for pumping washing liquid from the water container 26 through its bottom outlet 47 and by means of drain conduits or hoses 54 and 55 to a remote drain (not shown).

Figure 2:
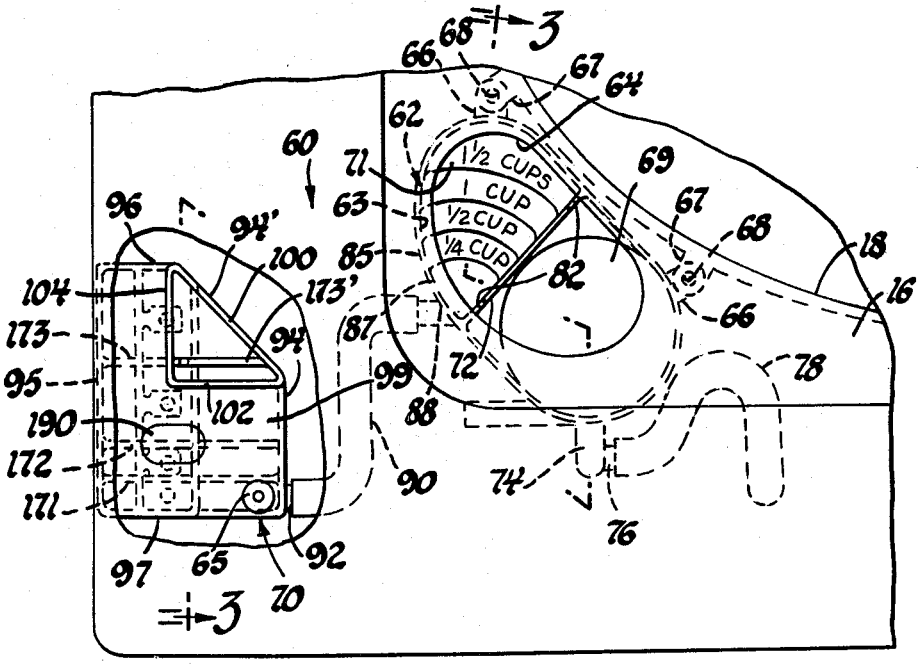
FIG. 2 is a fragmentary top elevational view with parts broken away taken substantially along the line 2—2 of FIG. 1.

As best seen in FIG. 2 located at the front lefthand corner of the washing machine 10 is a dispenser means or apparatus shown generally at 60. The dispenser apparatus includes a liquid additive receiving or pour-in container 62 located with its upper open end 63 contacting the undersurface of the recessed ledge portion or sub-top 16 so as to circumscribe elongated fill opening 64 in the cabinet sub-top such that the lid 20 conceals the dispenser means when it is in its lowered or closed position. The receiving container 62 is supported or mounted in the space between the sub-top 16 and the top of the water container 24 by suitable means. In the form shown outwardly projecting ears 66 integral with the liquid receiving container 62 overlie cooperating lug members 67 extending radially from the cabinet wall portions to receive fastening members (not shown) in their aligned openings 68. The dispenser apparatus 60 further includes a storage container 70 which is mounted by suitable means, such as integral screw receiving boss 65, in the left front corner of the cabinet 12 at a predetermined vertical height relative to the receiving container 62.

Figures 3, 4:
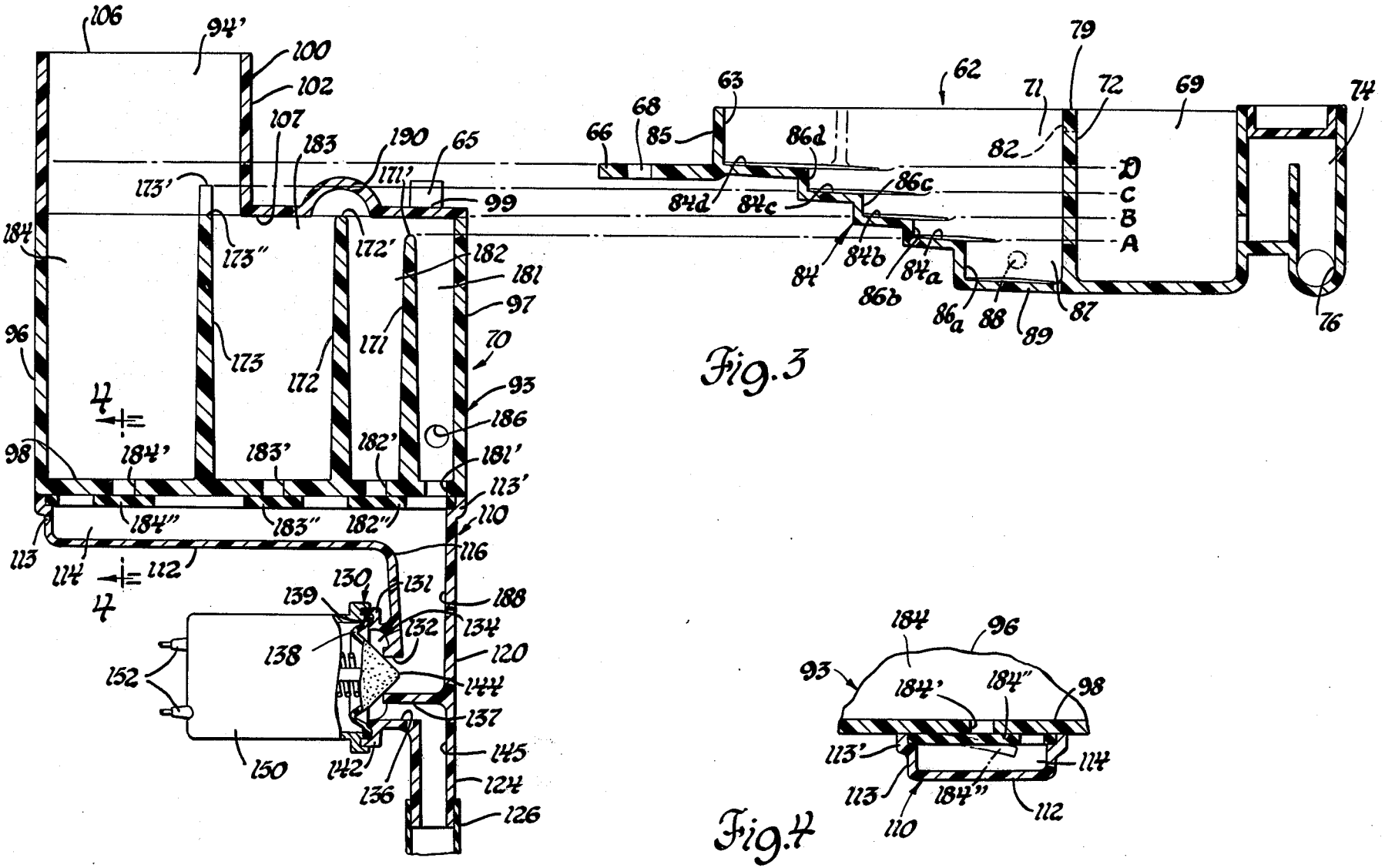
FIG. 3 is an enlarged composite fragmentary sectional view of both the receiving container and the storage container taken substantially along the line 3—3 of FIG. 2.
FIG. 4 is an enlarged fragmentary sectional view taken substantially along the line 4—4 of FIG. 3.

The sub-top fill opening 64 is shown providing access to a plurality of compartents to receive various liquid washing agents. In the form shown, for example, a laundry agent such as liquid fabric conditioner may be placed in compartment 69. Compartment 71 which is the subject of the present invention, is separated from liquid additive compartment 69 by a vertical divider 72. It will be understood that while in the preferred form compartment 71 will be described for use as a liquid bleach receiving container other liquid additives could be employed without departing from the scope of the present invention. As seen in FIGS. 2 and 3, the compartment 69 may include a siphon chamber 74, having an outlet 76 connecting it by suitable means such as conduit 78 to the washer treatment zone or container 26.

Turning now more specifically to the present invention it will be seen in FIGS. 1 and 2 that the additive receiving container 62 is easily visible and readily accessible through the elongated recessed opening 64 when the lid 20 is in its raised position. The container 62 is shown as including both the bleach receiving compartment 71 and the fabric conditioner compartment 69 to provide a composite member preferably formed as a single molding of plastic material. As stated above, the two compartments 69 and 71 are separated by the intermediate divider 72 arranged with its upper edge 79 located beneath the plane of the outer sides and ends of the container 62. Each end of the divider 72 preferably includes a notched-out weir portion 82 allowing any overflow of bleach in the compartment to drain into the adjacent compartment 69. By virtue of such an overflow arrangement applicant insures that an additive such as liquid bleach is prevented from flowing directly into the clothes treatment zone of container 24.

As seen in FIGS. 2 and 3, compartment 71 is in the form of a shell-like structure defined by a sloping bottom wall portion 84 joined to a peripheral upstanding arcuate wall portion 85. The bottom wall portion 84 is provided with a plurality of liquid level indicating means. In the preferred embodiment the bottom wall portion has a plurality of horizontal steps defining vertically spaced parallel surfaces or plateaus **84*a*, 84*b*, 84*c* and 84*d* separated by vertical risers 86*a*, 86*b*, 86*c* and 86*d*. The horizontal surfaces 84*a*–84*d* provide readily observable liquid level indicators denoting stored liquid volumes of bleach. For example, when the dispenser means 60 is being filled with bleach in a manner to be described, the bleach free surface rises until it reaches the first horizontal surface 84*a* indicating the dispenser 60 storage volume is one-fourth cup of liquid bleach. In a like manner at the instant the second surface 84*b* is awash with bleach a liquid level representing the storage of one-half cup of bleach is denoted. At the time the third surface 84*c* first becomes submerged the operator is informed that there exists a storage volume of one cup, while upon the uppermost fourth surface 84*d* first becoming awash indicates to the operator a storage of one and one-half cups of bleach. As seen in FIG. 2, the surfaces 84*a*–84*d*** are marked with their corresponding liquid volumes providing ready indicia for the user.

As viewed in FIG. 3, outlet means are provided for compartment 71 in the form of a connector 88 which extends outwardly from the arcuate side wall portion 87 just above horizontal base wall portion 89 of the container 62 which connector receives one end of flexible hose or conduit 90. From the plane view of FIG. 2 it will be noted that the conduit 90 provides communication with an inlet connector 92, integrally molded on one side wall 94 of the storage container 70.

The storage container 70 comprises a generally box-shaped molded plastic upper body section 93 formed with sidewalls 94 and 95, end walls 96 and 97 interconnected by a bottom wall 98. The side wall 94 includes an angular or beveled corner portion 94'. The formation of the side and bottom walls together with the top wall 99 from a tower 100 defining an upwardly extending triangular-shaped enclosure formed by right-angled wall portions 102 and 104 together with the vertical extension of beveled corner portion 94'. The upstanding tower 100 has an upper open end 106 providing an air vent allowing the escape of any entrapped air in upper chamber 107 of the container 70 to exit upwardly therethrough to the atmosphere.

Located on the underside of the container section 93 is a lower discharge section, generally indicated at 110, including an elongated base portion 112 having peripheral upstanding side wall portions 113, which, in conjunction with the upper section bottom wall 98, define a sealed lower storage chamber 114 provided with an outlet 116 at one end thereof. In the preferred embodiment the discharge section 110 is in the form of a single molding of plastic material with the outwardly displaced edges of its peripheral bead portion 113' sealed, as by welding, to the underside of the upper section bottom wall 98.

The lower section 110 has its outlet formed as a protuberance or stem 120 descending from base portion 112. The stem lower end provides a hose fitting 124 adapted for connection in any conventional manner with a liquid additive conduit 126 in communication with the water container 26. In FIG. 1 of the disclosed embodiment the conduit 126 is connected to an inlet formed in the washer sump 47.

As seen in FIGS. 1 and 3, a valve arrangement 130 including a housing 131 is formed integral with the stem 120. The housing includes a centrally disposed inlet port 132 leading into a dish-like annular valve chamber 134 having a lower valve outlet port 136 communicating therewith and separated from the inlet port 132 by a flow wall 137 integral with the stem. The inlet port 132 outwardly facing exit defines a valve seat portion adapted to be closed by a valve member 140 comprising a flexible disc-shaped diaphragm 138 which has a beaded rim portion 139 pressed into an annular groove formed in valve housing shoulder 142 circumscribing the valve chamber 134 such that the beaded rim 139 of the diaphragm provides a leakproof seal between the walls of the valve housing and the diaphragm 138. The diaphragm 138 has a central conical portion in the form of a flexible valve head member 144 which is moved to and from the inlet port 132 by an armature portion (not shown) of a solenoid 150 carried by suitable solenoid tabs fastened to radiating ear-like brackets integrally molded to the housing shoulder 142 as indicated at 151 in FIG. 1.

The solenoid 150 may be of any type compatible with the electrical system of the machine and capable of drawing the valve head member 144 from its spring biased seated position shown. Conventional electrical connectors 152 are provided to connect the solenoid 150 to timer control means 156 having a timer control knob 157 located on the front of the console 14 by suitable electrical conductor wires. Energizing the solenoid draws its armature rod to the left opening valve to permit the contents of the lower chamber 114 to drain to the valve chamber 146 and via the outlet 136 into the tube 126 of the washing machine. When the solenoid is deenergized the parts resume the position shown in FIG. 3.

The storage container 70 upper chamber 107 is formed with a plurality of parallel spaced weir-like partitions which in the disclosed form are three in number indicated at 171, 172 and 173. The partitions divide the chamber 107 into a plurality of individual reservoirs shown by the four separate reservoirs 181, 182, 183 and 184 disposed one adjacent the other. The partitions 171–173 have their upper free edges 171', 172' and 173' arranged at predetermined ascending levels substantially corresponding with the liquid level indicia means of the receiving container 62 as indicated by the phantom construction lines A, B, C and D in FIG. 3. It will be seen that the first shortest partition 171, shown with its upper free edge 171' at a predetermined height indicated by line A, separates the first and second reservoirs 181 and 182. The second partition 172, with its upper free edge 172' at level B, separates the second reservoir 182 from the third reservoir 183, while the third partition 173, with its free edge 173' at level C, separates the third 183 and fourth 184 reservoirs.

The upper chamber reservoir 181 includes an inflow part 186 allowing bleach flowing through conduit 90 to enter the upper chamber 107 and is directed into the lower chamber 114 via reservoir 181 outlet port 181'. With the valve arrangement 130 closed the bleach enters the lower chamber 114 and fills same including the tubular portion 188 of the stem 120 upstream of the closed valve head 144. It will be noted that the remaining reservoirs 182, 183 and 184 are each provided with an outlet port shown at 182', 183' and 184' respectively in base 98.

As seen in FIGS. 3 and 4, each of the ports 182', 183' and 184' are covered by a flapper valve 182", 183" and 184" respectively. In the disclosed embodiment each of the flapper valves are formed by stamping from an integral elongated strip of rubber material having a thickness of about 1.5 millimeters. Thus, upon the lower chamber 114 being completely filled with bleach the upward pressure on the flapper valves is sufficient to retain each valve 182"–184" in sealed relation over its associated outlet port 182'–184', respectively.

In operation an operator will open the lid 20 of the clothes washer 10 to expose the bleach fill opening 64 for the dispenser. Bleach will be poured into the compartment 71 so as to exit the compartment outlet 88 for gravitation flow through condiut 90 and connector 92 into the upper storage container inlet 186 such that the first reservoir 181 and the lower chamber 14 are completely filled with bleach from the receiving compartment. Upon the bleach in reservoir 181 reaching an approximate height of about 3 millimeters below partition edge 171' the bleach will fill the conduit 90 and the lower portion of compartment 71 such that the step portion **84*a* is awash with bleach, indicating to the operator that one-quarter cup of bleach is stored in the dispenser. Clothing is placed in the spin tub 28 and the automatic washing cycle initiated through the central panel 14. The automatic timer 156 is set such that solenoid 150 is actuated at the desired point in the wash cycle. More particularly solenoid 150 will be energized to open valve inlet 132 to valve outlet 136 allowing the bleach to flow by way of conduit 126 into the spin tub 28**.

If one-half cup of stored bleach is desired the operator continues to fill the compartment 71 until the bleach rises and spills over the edge 171' of partition 171 and begins filling the next adjacent reservoir 182. The bleach level in the compartment 71 remains at the surface of the first step **84*a* until the bleach in the upper chamber 107 surpasses the level of edge 171' and overflows. At this instant the bleach level in compartment 71 rises to correspond to the rising level in the upper chamber 107. Upon the bleach level in the compartment 107 reaching the surface of step 84*b*** the operator knows there is one-half cup of bleach stored in the dispenser.

In a similar manner if one cup of bleach is sought to be stored, the operator continues to pour bleach into the compartment 71 until the bleach rises and spills over the free edge 172', aided by the arcuate wall 190 provided above the partition 172, and begin filling the next adjacent reservoir 183. Again the bleach level in the compartment 71 remains at the level of the second step **84*b* until the bleach in the upper chamber 107 surpasses the level of edge 172'. At this point the level in compartment 71 rises to correspond to the level in the upper chamber 107. Upon the bleach level in the compartment 100 reaching the height of step 84*c***, the operator knows there is one cup of bleach stored in the dispenser.

Lastly, if one and one-half cups of bleach is desired to be stored the operator continues to pour bleach into the compartment 71 such that bleach will spill over the free edge 173' with the aid of notched-out portions 173" and begin filling the next adjacent reservoir 184. As before, the bleach level in the compartment 71 remains at the level of the third step **84*c* until the bleach in the upper chamber 107 surpasses the level of edge 173'. As the level of bleach in tower 100 rises it correspondingly raises the level in the compartment 71 above surface 84*c*. Upon the bleach level rising to the level of the plane determined by construction line D to just overflow surface 84*d*** the operator has positive indication of the storage of one and one-half cups of bleach in the dispenser at this time.

As stated above, as the bleach level rises in reservoirs 182, 183 and 184 the static hydraulic head on the flapper valves 182", 183" and 184" respectively becomes equalized by virtue of open port 181'. Thus, during the dispenser mode of operation of more than one-quarter cup, the solenoid valve 130 is energized by the timer to move valve head 144 to the left causing the first reservoir 181 and the lower chamber 114 to drain. The result is that a head is created on the flapper valves of their respective reservoirs containing bleach, causing the flapper valves to move to their open position, such as indicated in dashed lines in FIG. 4 for valve 184" thereby draining the associated reservoir for flow through outlet 145 into the spin tub 28.

It will be appreciated that applicant's dispenser provides the operator with a direct indication of the amount of stored liquid when sufficient space between the spin tub 28 and the top of the clothes washer cabinet is unavailable for a suitable storage reservoir at the filling location.

While the embodiment of the present invention as herein disclosed constitutes a preferred form, it is to be understood that other forms might be adopted.

The embodiment of the invention in which an exclusive property or privilege is claimed are defined as follows:

1. In combination, a washing machine comprising a cabinet having water container means, liquid additive dispenser means for said machine including a liquid receiving container and a storage container, said receiving container having a top inlet opening and an outlet formed in the bottom thereof discharging gravitationally through first conduit means into said storage container whereby said storage container may be supported on said cabinet at a location remote from said liquid receiving member, said receiving container having at least one sloping wall formed with a plurality of vertically spaced liquid level indicating means each defining a horizontal plane whereby each said plane is disposed at a predetermined ascending liquid storage indicia level, the lowermost indicating means disposed at a first indicia level above said receiving container outlet, said storage container having a bottom, side walls and floor means separating said container into an upper chamber and a lower chamber, said lower chamber having an outlet formed in the bottom thereof discharging into second conduit means in communication with said water container means, dispenser valve means for selectively discharging all the liquid stored in said dispenser means from said lower chamber oulet into said second conduit means, said upper chamber having a plurality of vertical spaced weir-like partitions dividing same into a plurality of separate reservoirs disposed one adjacent the other, said partitions having their upper free edges serially arranged at predetermined ascending levels substantially corresponding with the liquid level indicia means of said receiving container whereby the first partition, having the lowermost upper free edge, separates the first and second reservoirs; the second portion, having the second lowermost upper free edge, separates the second and third reservoirs and so forth; whereby upon the first reservoir being completely filled with liquid from said receiving container the liquid will overflow the free edge of said first partition into the second reservoir and so forth, said first conduit means connecting said receiving container outlet with said first reservoir, each said reservoir with the exception of said first reservoir having individual reservoir valve means each operable when open to drain its associated reservoir into said lower chamber, said first reservoir having outlet means draining same into said lower chamber, each said reservoir valve means operated to its closed position responsive to a predetermined liquid head pressure in said lower chamber established by the filling with liquid of said lower chamber and said first reservoir, whereby upon said receiving container and said upper chamber being filled with liquid to a level coincident with a preselected receiving container indicating means, the opening of said dispensing valve means results in the reservoir valve means of each reservoir having liquid therein being moved to its open position in response to the drainage of liquid from said lower chamber and said first reservoir such that the total premeasured quantity of liquid stored in said dispensing means is discharged into said water container.

* * * * *